US009826307B2

(12) United States Patent
Kubota et al.

(10) Patent No.: US 9,826,307 B2
(45) Date of Patent: Nov. 21, 2017

(54) MICROPHONE ARRAY INCLUDING AT LEAST THREE MICROPHONE UNITS

(71) Applicant: TOA Corporation, Kobe-shi, Hyogo-ken (JP)

(72) Inventors: Hiroshi Kubota, Kobe (JP); Tomohiro Jonan, Kobe (JP)

(73) Assignee: TOA CORPORATION, Kobe-shi, Hyogo-ken (JP)

( * ) Notice: Subject to any disclaimer, the term of this patent is extended or adjusted under 35 U.S.C. 154(b) by 1 day.

(21) Appl. No.: 14/897,147

(22) PCT Filed: Jun. 11, 2013

(86) PCT No.: PCT/JP2013/066105
§ 371 (c)(1),
(2) Date: Dec. 9, 2015

(87) PCT Pub. No.: WO2014/199446
PCT Pub. Date: Dec. 18, 2014

(65) Prior Publication Data

US 2016/0150316 A1 May 26, 2016
US 2017/0164106 A9 Jun. 8, 2017

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/403* (2013.01);
(Continued)

(58) Field of Classification Search
CPC .... H04R 3/005; H04R 1/406; H04R 2430/21; H04R 2430/23; H04R 2201/403; H04R 2201/405; H04R 2203/12
(Continued)

(56) References Cited

U.S. PATENT DOCUMENTS 4,311,874 A 1/1982 Wallace, Jr.
5,657,393 A 8/1997 Crow
(Continued)

FOREIGN PATENT DOCUMENTS

JP 56-098094 A 8/1981
JP 59-069800 A 4/1984
(Continued)

OTHER PUBLICATIONS

English translation of International Search Report issued in connection with International Application No. PCT/JP2013/066105, mailed on Sep. 3, 2013, 2 pages.

*Primary Examiner* — Katherine Faley
(74) *Attorney, Agent, or Firm* — Duane Morris LLP

(57) ABSTRACT

A microphone array includes an n microphone units (where n is an integer equal to or larger than three). A first one of the microphone units includes three microphones ((14-1 through 14-3)) arranged in line at equal intervals. An m-th microphone unit (where m is a positive integer expressed by 1<m<n) includes the microphones at either end of an (m−1)-th microphone unit, and another microphone spaced from the microphone at one end of the (m−1)-th microphone unit by a distance substantially equal to the distance between the microphones at either end of the (m−1)-th microphone unit, and disposed at a location on the side of the (m−1)-th microphone unit opposite to the side where the microphone at the one end at the one end of the (m−1)-th microphone unit is disposed. The (m+1)-th microphone unit includes the microphones at either end of an m-th microphone unit, and another microphone spaced from the microphone at one end of the m-th microphone unit by a distance substantially equal to the distance between the microphones at either end of the m-th microphone unit, and disposed at a location on the side of the (m+1)-th microphone unit opposite to the side
(Continued)

where the microphone at the one end of the (m+1)-th microphone unit is disposed.

4 Claims, 6 Drawing Sheets

(52) U.S. Cl.
CPC .... *H04R 2201/405* (2013.01); *H04R 2203/12* (2013.01); *H04R 2430/21* (2013.01); *H04R 2430/23* (2013.01)

(58) Field of Classification Search
USPC ..... 381/91, 92, 361
See application file for complete search history.

(56) References Cited

U.S. PATENT DOCUMENTS

| | | | | |
|---|---|---|---|---|
| 5,673,325 | A * | 9/1997 | Andrea | H04M 1/05 379/392.01 |
| 2008/0260178 | A1 | 10/2008 | Tanaka | |
| 2009/0274333 | A1 * | 11/2009 | Lan | H04R 1/406 381/365 |

FOREIGN PATENT DOCUMENTS

| | | | |
|---|---|---|---|
| JP | 2000-354290 | A | 12/2000 |
| JP | 2005-260743 | A | 9/2005 |
| JP | 2007-129485 | A | 5/2007 |
| JP | 2013-093807 | A | 5/2013 |

* cited by examiner

MICROPHONE ARRAY INCLUDING AT LEAST THREE MICROPHONE UNITS

TECHNICAL FIELD

The content of Japanese Patent No. 3732041 and JP2013-93807A are incorporated herein by reference, in the disclosure in this description. The present invention relates to a microphone system employing a microphone array including a plurality of microphones.

BACKGROUND ART

An example of a microphone array including a plurality of microphones arranged in array is disclosed in Patent Literature 1. According to Patent Literature 1, first and second microphones are disposed with a predetermined distance D therebetween in a microphone array. A third microphone is disposed between the first and second microphones, being spaced by a distance D/2 from the first and second microphones. A fourth microphone is disposed at a location between the third and first microphones, being spaced by a distance D/4 from the first and third microphones. A fifth microphone is disposed at a location between the third and fourth microphones, being spaced from the third and fourth microphones by a distance D/8. A sixth microphone is disposed at a location between the fifth and third microphones, being spaced from the third and fifth microphones by a distance D/16. A seventh microphone is disposed at a location between the sixth and third microphones, being spaced from the third and sixth microphones by a distance D/32. A eighth microphone is disposed at a location between the seventh and third microphones, being spaced from the third and seventh microphones by a distance D/64.

Audio signals from these microphones, which form microphone units, are processed by beam forming. More specifically, the first through third microphones form a first microphone unit; first, fourth and third microphones form a second microphone unit; the third through fifth microphones form a third microphone unit; and the third, fifth and sixth microphones form a fourth microphone unit. The third, sixth and seventh microphones form a fifth microphone unit; and the third, seventh and eighth microphones form a sixth microphone unit. The audio signals from the first and second microphones in the first microphone unit are multiplied by a factor 0.5, and the audio signal from the third microphone is multiplied by a factor 1. The audio signals from the first through third microphones multiplied by the respective factors are combined by combining means into a composite signal. Similarly, in each of the second through sixth microphone units, the audio signals are processed in such a manner that the audio signals from the microphones located at the opposite ends of that microphone unit are multiplied by a factor of 0.5 with the audio signal from the microphone at the center of that microphone unit being multiplied by a factor 1, whereby a composite signal is formed. The thus produced composite signals are combined to thereby provide the microphone system with sharp directivity over a wide frequency range. Further, the audio signal from each of the microphones is provided with a delay in a delay circuit, and the delayed audio signals are supplied to a beam forming section. With this arrangement, influence of differences in distance between a speaker and the respective microphones is removed by providing a delay equal to the delay of the last arriving audio signal for the audio signals from the other microphones.

PRIOR ART LITERATURE

Patent Literature

Patent Literature 1: JP2013-93807A

DISCLOSURE OF THE INVENTION

Technical Problem

According to the technology disclosed in Patent Literature 1, the fourth through eighth ones of the eight microphones are disposed between the first and third microphones, and only the second microphone is disposed spaced from the first and third microphones. This makes the centers of sound collections by the respective microphone units dispersed, resulting in collection of the sound of a person speaking in front of the microphone array being unstable. Specifically, the center of sound collection by the first microphone unit is at the location where the third microphone is disposed, the sound collection center of the second microphone unit is at the location where the fourth microphone is disposed, and the sound collection center of the third microphone unit is at the location where the fifth microphone is disposed. The center of sound collection by the fourth microphone unit is at the location where the sixth microphone is disposed, the sound collection center of the fifth microphone unit is at the location where seventh microphone is disposed, and the sound collection center of the sixth microphone unit is at the location where the eighth microphone is disposed. Thus, the sound collection centers of the microphone units are dispersed along the length direction of the whole microphone array. Furthermore, the sound collection centers of the microphone units are unevenly distributed leftward of the lengthways center of the microphone array (=the location where the third microphone is disposed). Each microphone unit has such a characteristic that it can collect sound most efficiently around its sound collection center. Accordingly, when, for example, a speaker is making a speech at a location between the third and fourth microphones, the sound collection centers of many microphone units are in front of the speaker, thereby the sound can be collected efficiently, but, if the speaker makes a speech between the second and third microphones, the sound can be collected poorly. The orientation of directivity can be controlled by providing the audio signal from each of the microphones with a delay by use of the delay circuit, but, only when a speaker is making a speech at a location between the second and third microphones, a large delay must be provided, which gives an adverse influence to the sound collection characteristic of the whole microphone array.

An object of the present invention is to minimize, as much as possible, dispersion of sound collection centers of microphones of a microphone array arrangement along the length direction of the microphone array.

Solution to Problem

A microphone system according to an embodiment of the present invention includes a microphone array which includes n sets of microphone units, where n is a positive integer equal to three or larger. A first one of the microphone units includes three microphones arranged in line at regular intervals. An m-th microphone unit (where m is a positive integer greater than 1 and smaller than n) includes microphones at opposite ends of an (m−1)-th microphone unit and also one other microphone disposed at such a location spaced from the microphone at one end of the (m−1)-th microphone unit in a direction away from the microphone at the other end of the (m−1)-th microphone unit that the microphone at the one end is intermediate between the microphones at opposite ends of the (m−1)-th microphone unit. The one other microphone is spaced from the microphone at the one end by a distance substantially equal to the distance between the microphones at the opposite ends of the (m−1)-th microphone unit. An (m+1)-th microphone unit includes the microphones at the opposite ends of the m-th microphone unit and also one other microphone disposed at such a location spaced from the microphone at the other end of the m-th microphone unit in a direction away from the microphone at the other end of the m-th microphone unit that the microphone at the other end is intermediate between the microphones at opposite ends of the m-th microphone unit. The one other microphone of the m-th microphone unit is spaced from the microphone at the other end by a distance almost equal to the distance between the microphones at the opposite ends of the (m+1)-th microphone unit. Combining means combines audio signals which the microphones of the respective microphone units generate as a result of collecting sounds, and outputs a composite signal. In each microphone unit, it is desirable that the audio signals from the microphones at the opposite ends of that microphone unit are multiplied by a predetermined factor in multiplying means, the audio signal from the center microphone is multiplied by a factor larger than the said predetermined factor, for example, a factor twice the predetermined factor, in multiplying means, and, then, the multiplied audio signals are combined in the combining means. The composite signals outputted from the combining means are combined again in re-combining means. The audio signals from the respective microphones may be applied to the respective multiplying means after they are delayed in delaying means. In this case, the amounts of delay given by the respective delaying means are adjusted in accordance with differences in distance between the sound source from which the respective microphones collect and the respective microphones in such a manner that an equal delay is present in the audio signals from the respective microphones.

With this arrangement, the microphones disposed at the centers of the respective microphone units are disposed alternately on the opposite sides of the centrally positioned microphone of the first microphone unit. As a result, the microphones are not concentrated in an area between specific two microphones, but they are distributed to the opposite sides of the centrally disposed microphone of the first microphone unit, which results in the concentration of the sound collection centers of the respective microphone units in an area near the centrally positioned microphone of the first microphone unit.

To arrange an (n+1)-th microphone unit, a microphone other than ones of an n-th microphone unit which is spaced from either one of the microphones at the opposite ends of the n-th microphone unit by a distance larger than the distance between the microphones at the opposite ends of the n-th microphone unit may be used as a centrally disposed microphone of the (n+1)-th microphone unit. In this case, that one of the microphones at the opposite ends of the n-th microphone unit which is spaced from the center microphone of the (n+1)-th microphone unit by a distance larger than the distance between the microphones of the n-th microphone unit is used as a microphone at one end of the (n+1)-th microphone unit. Another microphone is disposed on that side of the centrally located microphone of the (n+1)-th microphone unit which is opposite to the side where the said microphone at the one end of the (n+1)-th microphone unit is disposed. The said another microphone is spaced from the centrally disposed microphone of the (n+1)-th microphone unit by a distance substantially equal to the distance between the centrally disposed microphone and the microphone disposed at the said one end of the (n+1)-th microphone unit. The audio signals prepared from the sounds collected by the microphones of the (n+1)-th microphones are combined by another combining means and supplied to the re-combining means.

In this arrangement, the microphone other than ones of the n-th microphone unit which is spaced from either one of the microphones at the opposite ends of the n-th microphone unit by a distance larger than the distance between the microphones at the opposite ends of the n-th microphone unit is the centrally disposed microphone of the (n+1)-th microphone unit. Then, this microphone is the sound collection center of the outermost, (n+1)-th microphone unit. The centrally disposed microphones of other microphone units are also located near the centrally disposed microphone of the (n+1)-th microphone unit. By this arrangement, the sound collection centers of the respective microphone units are concentrated together around the location of the centrally disposed microphone of the (n+1)-th microphone unit. In addition, the distance between the centrally disposed microphone of the (n+1)-th microphone unit and the said another microphone of the (n+1)-th microphone unit added to form the (n+1)-th microphone unit is smaller than the distance between the microphones at the opposite ends of the n-th microphone unit, which makes it possible to shorten the length of the microphone array, resulting in downsizing the microphone system.

The microphones of the microphone system according to the described embodiment may be microphones having a microphone element within a case thereof. The case of each microphone is embedded in a microphone mounting section in such a manner that the microphone element is substantially tangential to the top of the microphone mounting section. The microphones may be, for example, unidirectional microphones. When unidirectional microphones are employed, their directivities are oriented in the same direction.

With this arrangement, a voice of a speaker enters into the respective microphones from, for example, slantwise above, but undesired voice reflected from the microphone mounting section hardly enters into the microphone elements and, accordingly, sound quality is hardly degraded.

In the arrangement described above, a base board on which the respective combining means and the re-combining means are mounted may be arranged to be slantwise with respect to the microphone array. The microphone array may be placed in a casing. In this case, walls of the casing are positioned outward of the opposite ends of the microphone array and are slanted with respect to the microphone array. In this case, too, the microphones may be unidirectional microphones with their orientations of directivity being the same.

With this arrangement, sounds reflected from the base board and/or the walls of the casing hardly enter into the microphones from behind.

DESCRIPTION OF EMBODIMENTS OF THE INVENTION

Figure 2:
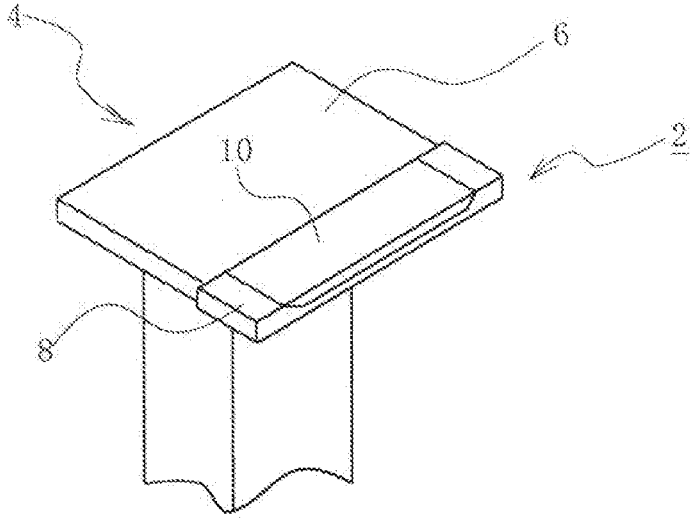
FIG. 2 is a perspective view of the microphone system according to the first embodiment.
Figure 3:
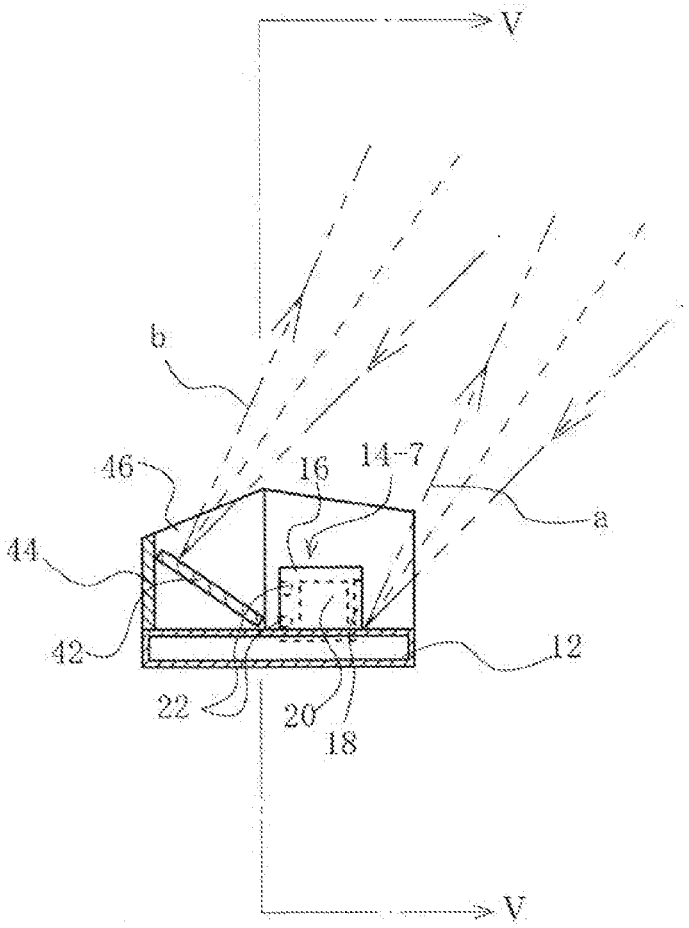
FIG. 3 is a longitudinal cross-sectional side view of the microphone system of FIG. 2.
Figure 4:
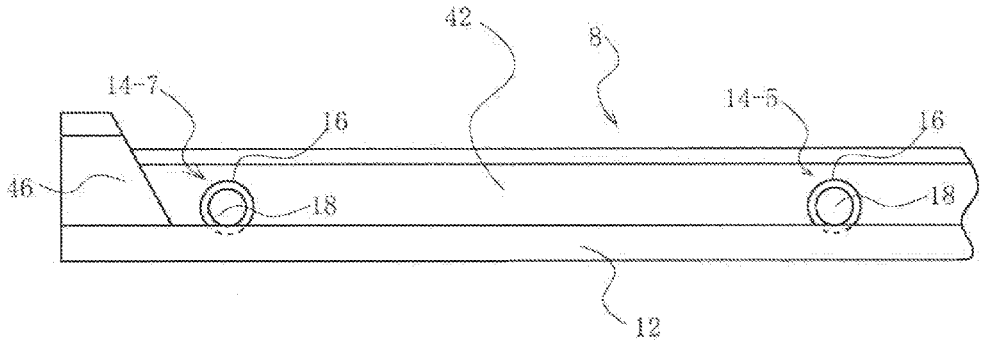
FIG. 4 is a front view of a part of the microphone system of FIG. 2 with a cover removed.

As shown in FIG. 2, a microphone system 2 according to one embodiment of the present invention is mounted on a top plate 6 of a speech stand 4 along one of the longitudinal edges thereof on the side where a speaker stands. The microphone system 2 has a casing 8. The casing 8 is in the shape of an elongated box having its top opened, and is disposed with its longer edges extending along the longitudinal edges of the top plate 6. A lid 10 is mounted to close the top opening of the casing 8. As shown in FIGS. 3 and 4, the casing 8 has a microphone installation part, e.g. a bottom wall 12 having a rectangular shape.

Figure 1:
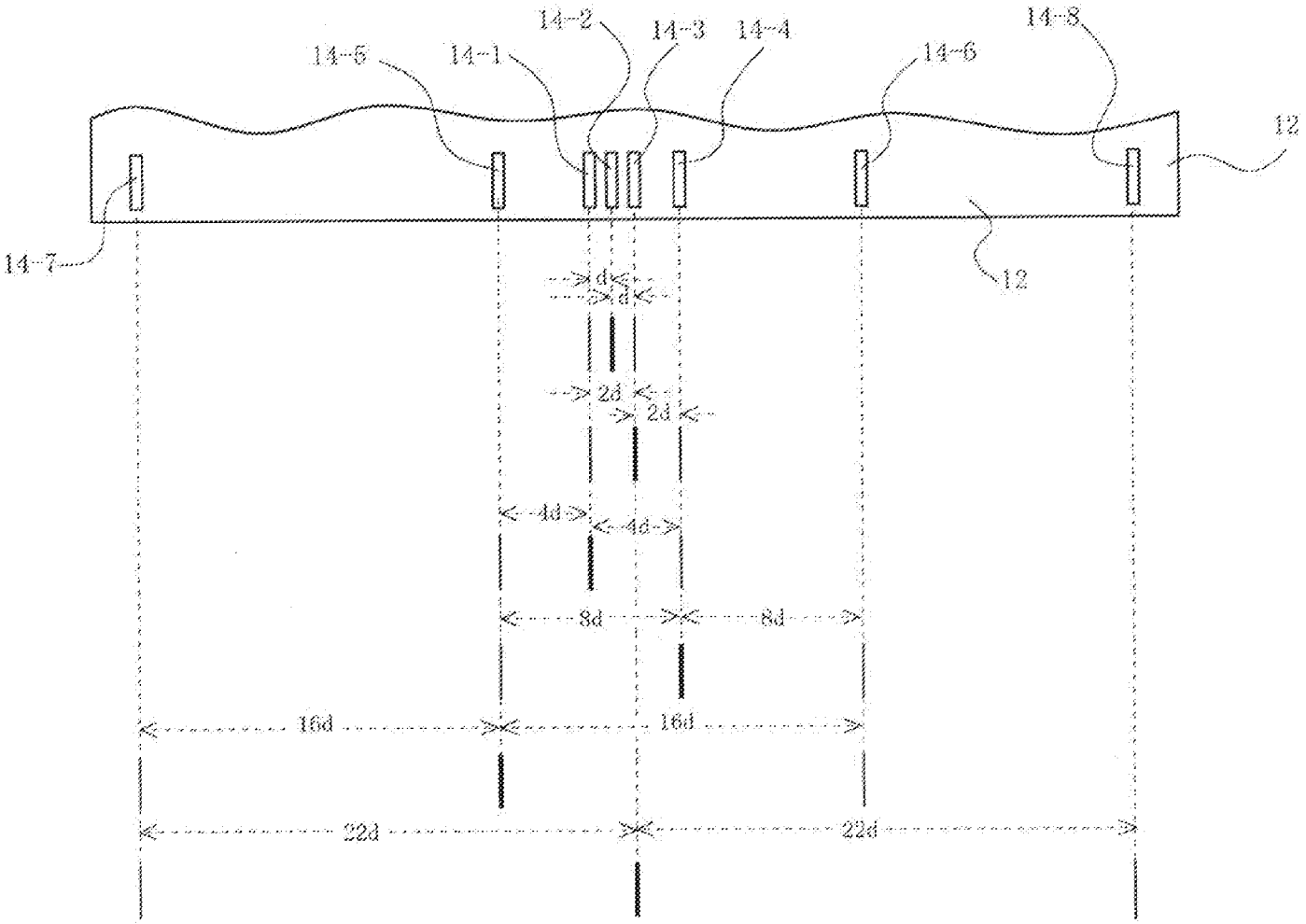
FIG. 1 is a plan view of a part of a microphone array of a microphone system according to a first embodiment of the present invention.
Figure 5:
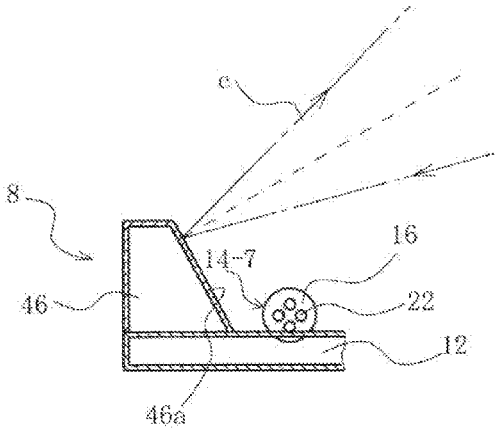
FIG. 5 is a cross-sectional view of the microphone system of FIG. 3 along a line V-V.

Plural, eight, for example, microphones (MICS), first through eighth microphones 14-1 through 14-8, are arranged as shown in FIG. 1 to form a microphone array on the bottom wall 12 along the other longitudinal edge thereof on the speaker side away from the top plate 6. The first through eighth microphones 14-1 through 14-8 are unidirectional microphones, for example. The first through eighth microphones 14-1 through 14-8 are arranged in such a manner that their orientations of the directivity are perpendicular to the longitudinal edges of the bottom wall 12 and toward the speaker. As shown in FIG. 3, each of these first through eighth microphones 14-1 through 14-8 has a case 16, which is cylindrical, for example. The cylindrical case 16 is disposed with its one end facing to the speaker, and has a sound inlet opening 18 formed in the said one end. A microphone element 20 is disposed in the case 16, being pointed to the speaker. The microphone element 20 is disposed within the case 16 with its center aligned with the center of the opening 18. In the other end of each case 16, plural, e.g. four, through-holes 22 are formed as shown in FIGS. 3 and 5.

As shown in FIGS. 3 and 4, each of the first through eighth microphones 14-1 through 14-8 has its case 16 embedded in the bottom wall 12 so that the opening 18 is in contact with the upper surface of the bottom wall 12. Usually, the head of the speaker is above the top plate 6 and, therefore, the sound from the speaker comes to the microphones 14-1 through 14-8 slantwise from above the top plate 6. If the cases 16 of the microphones are mounted on the bottom wall 12 with the openings 18 positioned above the upper surface of the bottom wall 12, the voice of the speaker directly enters through the openings 18 and reaches the respective microphone elements 20, and, at the same time, the sound reflected from the upper surface of the bottom wall 12 also enters through the openings 18 and reaches the microphone elements 20. In such a case, the directly coming voice of the speaker may be interfered by the reflected voice to degrade the sound quality. The openings 18 are positioned in contact with the upper surface of the bottom wall 12 to prevent the interference. With this arrangement, the voice reflected from the bottom wall 12 hardly enters through the openings 18 into the cases 16, as indicated by "a" in FIG. 3.

As shown in FIG. 1, the first microphone 14-1 is disposed substantially at the intermediate location along the length direction of the bottom wall 12. The second microphone 14-2 is disposed, being spaced from the first microphone 14-1 by a predetermined distance d. The third microphone 14-3 is disposed on the side of the second microphone 14-2 opposite to the first microphone 14-1, being spaced by the distance d from the second microphone 14-2. The first through third microphones 14-1 through 14-3 form a first microphone unit including the centrally disposed second microphone 14-2 with the first and third microphones 14-1 and 14-3 disposed on the opposite sides.

Thus, as is seen in FIG. 1, the first microphone 14-1 and the third microphone 14-3 are spaced from each other by a distance 2*d*. A fourth microphone 14-4 is disposed on the side of the third microphone 14-3 opposite to the first microphone 14-1, being spaced from the third microphone 14-3 by the distance 2*d*. A second microphone unit is formed by the first, third and fourth microphones 14-1, 14-3 and 14-4, with the third microphone 14-3 located at the center and the first and fourth microphones 14-1 and 14-4 located on the opposite sides of the third microphone 14-3.

Thus, as shown in FIG. 1, the fourth microphone 14-4 and the first microphone 14-1 are spaced from each other by a distance 4*d*. A fifth microphone 14-5 is disposed on the side of the first microphone 14-1 opposite to the fourth microphone 14-4, being spaced by the distance 4*d* from the first microphone 14-1. The first, fourth and fifth microphones 14-1, 14-4 and 14-5 form a third microphone unit, with first microphone 14-1 located at the center and the fourth and fifth microphones 14-4 and 14-5 located on the opposite sides of the first microphone 14-1.

Thus, the fifth microphone 14-5 and the fourth microphone 14-4 are spaced from each other by a distance 8*d*, as shown in FIG. 1. A sixth microphone 14-6 is disposed on the side of the fourth microphone 14-4 opposite to the fifth microphone 14-5, being spaced by the distance 8*d* from the fourth microphone 14-4. The fourth, fifth and sixth microphones 14-4, 14-5 and 14-6 form a fourth microphone unit, with the fourth microphone 14-4 located at the center and the fifth and sixth microphones 14-5 and 14-6 located on the opposite sides of the fourth microphone 14-4.

Thus, the fifth microphone 14-5 and the sixth microphone 14-6 are spaced from each other by a distance 16*d*, as shown in FIG. 1. A seventh microphone 14-7 is disposed on the side of the fifth microphone 14-5 opposite to the sixth microphone 14-6, being spaced by the distance 16*d* from the fifth microphone 14-5. The fifth, sixth and seventh microphones 14-5, 14-6 and 14-7 form a fifth microphone unit, with the fifth microphone 14-5 located at the center and the sixth and seventh microphones 14-6 and 14-7 located on the opposite sides of the fifth microphone 14-5.

As is understood from FIG. 1, in these, first through fifth microphone units, the third microphone 14-3, which is located at the center of the second microphone unit, is located on one side, or on the right side in FIG. 1, of the centrally disposed second microphone 14-2 of the first microphone unit, and the first microphone 14-1, which is the centrally disposed microphone of the third microphone unit, is located on the other side, the left-hand side in FIG. 1, of the centrally disposed, second microphone 14-2 of the first microphone unit. The fourth microphone 14-4, which is the centrally disposed microphone of the fourth microphone unit, is located on the right-hand side of the second microphone 14-2, which is the centrally disposed microphone of the third microphone unit, and at the same time, outward of the third microphone 14-3 of the centrally disposed microphone of the second microphone unit. The fifth microphone 14-5, which is the centrally disposed microphone of the fifth microphone unit, is located on the left-hand side of the second microphone 14-2, which is the centrally located microphone of the first microphone unit, and is also located leftward of the first microphone 14-1, which is the centrally located microphone of the third microphone unit. As described, the centrally located microphones of the second and higher ordinal-numbered microphone units are alternately located on the opposite sides of the centrally located microphone of the first microphone unit.

Assume, for example, a case in which seven microphones are arranged according to the microphone arrangement disclosed in JP2013-93807 or Japan Patent No. 3732041. In this case, between a microphone corresponding to the third microphone 14-3 in FIG. 1 of the present application and a microphone corresponding to the seventh microphone 14-7, the remaining five microphones are disposed, and thus no microphones are present on the right-hand side of the microphone corresponding to the third microphone 14-3. In the microphone array shown in FIG. 1 of the present application, the fourth and sixth microphones 14-4 and 14-6 are arranged on the right-hand side of the third microphone 14-3 of FIG. 1.

The arrangement of the microphones of the first through fifth microphone units may be generalized as follows. Let it be assumed that there are n microphone sets or units (five microphone units in the embodiment being explained). In this case, an m-th (where $1<m<n$) microphone unit includes the microphones at the opposite ends of the (m−1)-th microphone unit, and another microphone spaced, by a distance substantially equal to the distance between the microphones at the both ends of the (m−1)-th microphone unit, from the microphone at one side end of the (m−1)-th microphone unit away from the microphone at the other side end of the (m−1)-th microphone unit, with the microphone at the said one side end of the (m−1)-th microphone unit being between the said another microphone and the microphone at the other side end of the (m−1)-th microphone unit. The (m+1)-th microphone unit includes the microphones at the opposite ends of the m-th microphone unit, and another microphone spaced, by a distance substantially equal to the distance between the microphones at the both ends of the m-th microphone unit, from the microphone at the other side end of the m-th microphone unit away from the microphone at the one side end of the m-th microphone unit, with the microphone at the other side end of the m-th microphone unit being between the said another microphone and the microphone at the one side end of the m-th microphone unit. The number of the microphone units is not limited to five, but it can be any positive integer equal to three or larger. In such case, m is a positive integer expressed as ($1<m<n$). In the example shown in FIG. 1, the "one side" is the right-hand side of the second microphone 14-2, and the "other side" is the left-hand side of the second microphone 14-2. But, it may be inverted, i.e. the "one side" may be the left-hand side of the second microphone 14-2 with the "other side" being the right-hand side of the second microphone 14-2.

In the described embodiment, a sixth microphone unit is provided, too. If the sixth microphone unit were arranged similar to the second through fifth microphone units, an eighth microphone 14-8 should be disposed away from the sixth microphone 14-6 toward the side opposite to the side where the seventh microphone 14-7 is disposed by the distance 32*d* between the seventh and sixth microphones 14-7 and 14-6. Then, the sixth microphone unit would be formed by the seventh microphone 14-7, the sixth microphone 14-6 and the eighth microphone 14-8. With this arrangement, however, the sound collection centers of the first through sixth microphone units would be distributed in the side shifted from the longitudinal center of the microphone array (i.e. in the left-hand area in FIG. 1). In other words, the centrally disposed, sixth microphone 14-6 of the sixth microphone unit, which is located outermost of all the microphone unit, would be at the longitudinal center of the microphone array. Then, the sound collection centers of the first through fifth microphone units would be dispersed in the area on one side (i.e. left-hand side in FIG. 1) of the longitudinal center of the microphone array.

To avoid such distribution, according to the invention, the following arrangement is employed. First, out of the microphones used to form the first through fifth microphone units, excluding the fifth microphone unit nearest to the sixth microphone unit, the fifth microphone 14-5, the first microphone 14-1, the second microphone 14-2, the third microphone 14-3 and the fourth microphone 14-4 are selected. Then, out of these microphones, one of the microphones, i.e. the first microphone 14-1, the second microphone 14-2, the third microphone 14-3 and the fourth microphone 14-4 which do not form a microphone unit with the seventh microphone 14-7 is chosen. Then, one of these microphones spaced from the sixth and seventh microphones 14-6 and 14-7 at the opposite ends of the fifth microphone unit by a distance larger than the distance 16*d* between the fifth microphone 14-5 and the sixth and seventh microphones 14-6 and 14-7 of the fifth microphone unit, e.g. the third microphone 14-3 is chosen. Then, this third microphone 14-3 is disposed at the center of the sixth microphone unit. Then, the eighth microphone 14-8 is disposed on the side of the third microphone 14-3 opposite to the seventh microphone 14-7, being spaced from the third microphone 14-3 by a distance 22*d*, which is equal to the distance between the third and seventh microphones 14-3 and 14-7.

With this arrangement, the distance between the seventh microphone 14-7 and the eighth microphone 14-8 is 44*d*, which is shorter than the above-quoted distance 64*d*. This means that it is possible to downsize the microphone array formed by the first through eighth microphones 14-1 through 14-8, and at the same time, to concentrate the sound collection positions of the microphone units around the midpoint of the length of the microphone array. In other words, the sound collection center of the outermost, sixth microphone unit is at the location of the third microphone 14-3, and, thus, the center of the whole microphone array is located at the third microphone 14-3. As a result, as indicated by thick lines in FIG. 1, all of the sound collection center of the first microphone unit (=the location of the second microphone 14-2), the sound collection center of the second microphone unit (=the location of the third microphone 14-3), the sound collection center of the third microphone unit (=the location of the first microphone 14-1), the sound collection center of the fourth microphone unit (=the location of the fourth microphone 14-4), the sound collection center of the fifth microphone unit (=the location of the fifth microphone 14-5), and the sound collection center of the sixth microphone unit (=the location of the third microphone 14-3) are gathered and concentrated about the center of the whole microphone array (=the location of the third microphone 14-3).

It should be noted that a microphone array downsized more than the above-described embodiment can be realized by using the first or second microphone 14-1 or 14-2 as the center microphone of the sixth microphone unit. Also, if a resulting microphone array can be larger than the described embodiment, the fourth microphone 14-4 is used as the center microphone of the sixth microphone unit.

The arrangement of the sixth microphone unit may be generalized as follows. To form an (n+1)-th microphone unit, one, not belonging to the n-th microphone unit, of the microphones described above is used as the center microphone of the (n+1)-th microphone unit. The distance of this center microphone from either one of the microphones at the opposite ends of the n-th microphone unit is larger than the distance between the distances among the microphones of the n-th microphone unit. Other one of the microphones at the opposite ends of the n-th microphone unit, which other one microphone is spaced from the center microphone of the (n+1)-th microphone unit by a distance larger than the distance between the microphones of the n-th microphone unit, is used as a microphone at one end of the (n+1)-th microphone unit. At a location on the side of the center microphone of the (n+1)-th microphone unit opposite to the said microphone at the one end of the (n+1)-th microphone unit, another microphone is disposed as the microphone of the (n+1)-th microphone unit. This microphone is spaced from the center microphone by the distance substantially equal to the distance between the center microphone and the said other one microphone of the (n+1)-th microphone unit.

Figure 6:
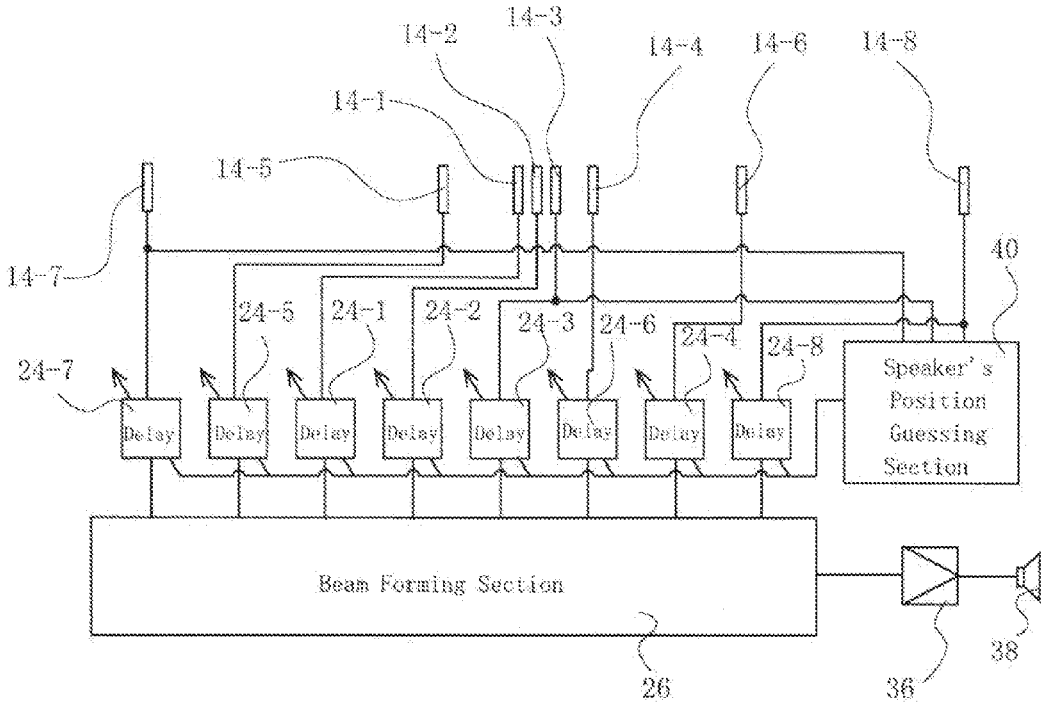
FIG. 6 is a block diagram of the microphone system of FIG. 2.
Figure 7:
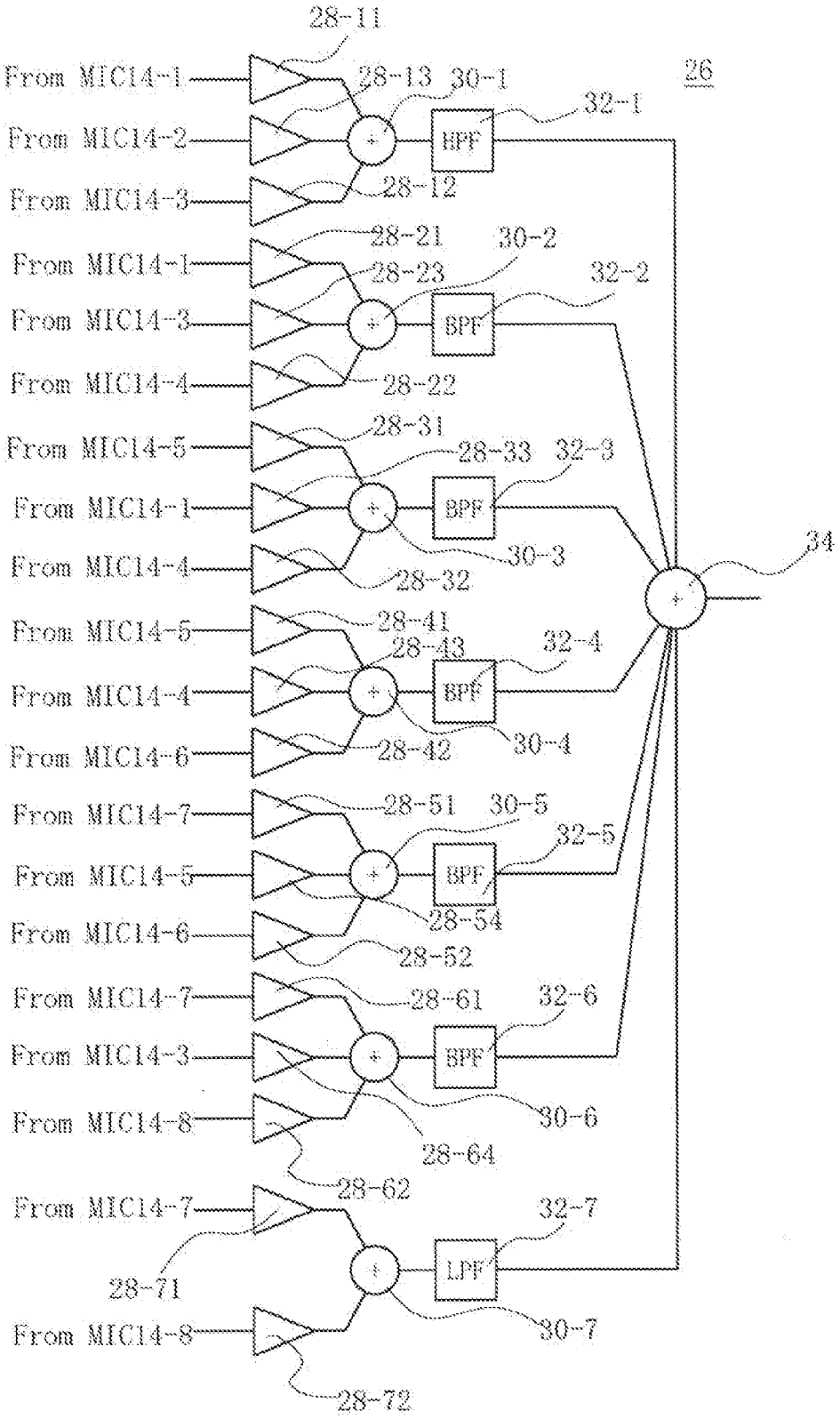
FIG. 7 is a detailed block diagram of a beam forming section shown in FIG. 6.

The first through eighth microphones 14-1 through 14-8 provide audio signals corresponding to the voice of the speaker, and, as shown in FIG. 6, these audio signals are respectively supplied through variable delay means, e.g. variable delay circuits 24-1 through 24-8, provided for the first through eighth microphones to directivity adjusting means, e.g. a beam forming section 26. The function of the variable delay circuits 24-1 through 24-8 is described later. In the following explanation about the beam forming section 26, the variable delay circuits 24-1 through 24-8 are not taken into consideration.

In the beam forming section 26, audio signals from microphones forming each microphone unit are processed. Specifically, audio signals from two microphones at the opposite ends of each microphone unit, formed of three microphones, are multiplied by a predetermined factor, e.g. 0.5, by multiplying means, or, for example, amplified by an amplifier. An audio signal from the centrally disposed microphone is multiplied by a factor larger than the above-stated predetermined factor, e.g. 1 (unity) which is twice the predetermined factor, by multiplying means, or, for example, amplified by an amplifier. The multiplied, e.g. amplified, audio signals are combined by combining means, e.g. added together by an adder. This processing gives each microphone unit a sharp directivity at a frequency determined by the distance between the microphones forming that microphone unit as disclosed in, for example, Japan Patent No. 3732041.

Let the first microphone unit, for example, be considered. The audio signals from the opposite end microphones 14-1 and 14-3 are amplified respectively by amplifiers 28-11 and 28-12 having their gains adjusted to 0.5. The audio signal from the centrally disposed microphone 14-2 of the first microphone unit is amplified by an amplifier 28-13 having its gain adjusted to unity. The output signals of the amplifiers 28-11 through 28-13 are added together by an adder 30-1. Then, the output signal of the adder 30-1 exhibits a sharp directivity at a frequency f1 determined by the distance d between the microphones of the first microphone unit.

Similarly, the audio signals from the opposite end microphones 14-1 and 14-4 of the second microphone unit are amplified by amplifiers 28-21 and 28-22, which are arranged similarly to the amplifiers 28-1 and 28-2, and the audio signal from the centrally disposed microphone 14-3 is amplified by an amplifier 28-23 having the same configuration as the amplifier 28-13. The output signals of the amplifiers 28-21 through 28-23 are added together by an adder 30-2. The output signal of the adder 30-2 exhibits a sharp directivity at a frequency f2 (f1>42) determined by the distance 2*d* between the microphones of the second microphone unit. Similarly, the audio signals from the first through sixth microphone units are processed by amplifiers 28-31, 28-32, 28-33, 28-41, 28-42, 28-43, 28-51, 28-52, 28-54, 28-61, 28-61 and 28-64, and adders 30-3 through 30-6. The output signals from the adders 30-3 through 30-6 for the third through sixth microphone units exhibit sharp directivities at frequencies f3 through f6 (f3<f4<f5<f6) which are determined by the distances 4*d*, 8*d*, 16*d* and 22*d*, respectively.

The audio signals from the opposite end microphones 14-7 and 14-8 of the sixth microphone unit are multiplied by a factor 1 (unity) by multiplying means, for example, or amplified by amplifiers, for example, 28-71 and 28-72. The output signals of the amplifiers 28-71 and 28-72 are combined, e.g. added together, by combining means, e.g. an adder 30-7, whereby, as disclosed in Japanese Patent No. 3732041, the output signal of the adder 30-7 exhibits a sharp directivity at a frequency f7 (f6>f7) which is determined by the distance 44*d* between the seventh and eighth microphones 14-7 and 14-8.

The output signal of the adder 30-1 is supplied to extracting means, e.g. a high-pass filter (HPF) 32-1. The high-pass filter 32-1 has a cutoff frequency lower than the frequency f1, and extracts, from the output signal of the adder 30-1, frequency components having frequencies higher than the cutoff frequency. The output of the adder 30-2 is applied to extracting means, e.g. a band-pass filter (BPF) 37-2, which extracts, from the output signal of the adder 30-2, components in a band having an upper limit frequency higher than the frequency f2, e.g. the cutoff frequency of the high-pass filter 32-1, and a lower limit frequency at a predetermined frequency between the frequency f2 and the frequency f3.

Similarly, the output signals of the adders 30-3 through 30-6 are applied to extracting means, e.g. band-pass filters 32-3 through 32-6, respectively. The band-pass filter 32-3 has a pass band of which upper limit frequency is a frequency higher than the frequency f3, e.g. the lower limit frequency of the band-pass filter 32-2, and of which lower limit frequency is a predetermined frequency between the frequencies f3 and f4. The band-pass filter 32-4 has a pass band of which upper limit frequency is a frequency higher than the frequency f4, e.g. the lower limit frequency of the band-pass filter 32-3, and of which lower limit frequency is a predetermined frequency between the frequencies f4 and f5. The band-pass filter 32-5 has a pass band of which upper limit frequency is a frequency higher than the frequency f5, e.g. the lower limit frequency of the band-pass filter 32-4, and of which lower limit frequency is a predetermined frequency between the frequencies f5 and f6. The band-pass filter 32-6 has a pass band of which upper limit frequency is a frequency higher than the frequency f6, e.g. the lower limit frequency of the band-pass filter 32-5, and of which lower limit frequency is lower than the frequencies f6.

The output of the adder 30-7 is applied to extracting means, e.g. a low-pass filter 32-7, which has a pass band of which cutoff frequency is a frequency higher than the frequency f7, e.g. the lower limit frequency of the band-pass filter 32-6.

Figure 8:
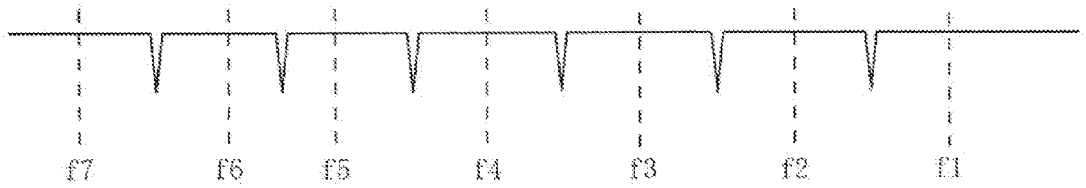
FIG. 8 shows a frequency characteristic of the microphone system of FIG. 2.

The output signals of the adders 30-1 through 30-7 which have passed through the high-pass filter 32-1, the band-pass filter 32-2 through 32-6, and the low-pass filter 32-7 are combined again, e.g. added together, by re-combining means, e.g. an adder 34. The frequency characteristic of the output signal of the adder 34 is shown in FIG. 8. As is seen from FIG. 8, the output signal of the adder 34 has a broad frequency band. In addition, it exhibits sharp directivity at the frequencies f1 through f7, as stated above.

As shown in FIG. 6, the output signal of the adder 34, i.e. the output signal of the beam forming section 26, is power-amplified by amplifying means, e.g. a power amplifier 36, and applied to loudspeaker means, e.g. a loudspeaker 38, whereby the voice of the speaker widely carry to the audience.

In the description of the beam forming section 26 given above, consideration has not been given to the variable delay circuits 24-1 through 24-8. The above description of the beam forming section 26 is based on the assumption that the speaker is giving a speech at a position so remote from the first through eighth microphones 14-1 through 14-8 that differences in distance between the speaker and the respective microphones 14-1 through 14-8 can be ignored. However, as shown in FIG. 2, the microphone system 2 is mounted on the top plate 6 of the speech stand 4, and the speaker usually gives speech at a position near to the speech stand 4. Accordingly, there are differences between the speaker and the respective ones of the microphones 14-1 through 14-8, which causes time differences in arriving of the voice of the speaker at the respective microphones 14-1 through 14-8. It may make the sound quality provided by the re-combined signal outputted from the beam forming section 26 different from the expected sound quality.

According to this embodiment, in order to lessen such disadvantage, the audio signals from the first through eighth microphones 14-1 through 14-8 are applied to the respective ones of the variable delay circuits 24-1 through 24-8, and amounts of delay determined according to the delay of the audio signal arriving last at the corresponding microphone are imparted to the audio signals from other microphones so that all the audio signals are in phase with each other before they are applied to the beam forming section 26. By such processing, according to the phased array antenna principle, the resultant directivity of the first through eighth microphones 14-1 through 14-8 is oriented toward the speaker.

In order to determine the amounts of delay to be imparted for the respective ones of the variable delay circuits 24-1 through 24-8 and set the thus determined amounts of delay in the respective variable delay circuits 24-1 through 24-8, it is necessary to first guess the location of the speaker and to determine the distance between the speaker and each of the first through eighth microphones. The speaker may move or turn his or her face facing the front to the right or left stage. In such case, the distance between the speaker and each of the first through eighth microphones changes. When the distance changes, it is necessary to change the amounts of delay set in the respective variable delay circuits 24-1 through 24-8 accordingly.

In the present embodiment, delay amount setting means, e.g. a speaker's position guessing section 40, is provided to deal with it. The speaker's position guessing section 40 is provided with the audio signals from the first, seventh and eighth microphones 14-1, 14-7 and 14-8. The speaker's position guessing section 40 has the same configuration as a sound source position guessing section disclosed in JP2013-93807A, and therefore detailed description of its configuration and operation is not given here.

The variable delay circuits 24-1 through 24-8, the speaker's position guessing section 40 and the beam forming section 26 are mounted on, for example, a base board 42 in the shape of rectangle shown in FIGS. 3 and 4. The base board 42 is disposed on the bottom wall 12 at location behind the first through eighth microphones 14-1 through 14-8. The base board 42 is disposed on the bottom wall 12 to extend slantwise upward in the direction away from the first through eighth microphones 14-1 through 14-8. In other words, as shown in FIG. 3, one of the longer sides of the base board 42 is disposed on the bottom wall 12, and the other longer side is positioned to contact the upper portion of a rear wall 44 of the casing 8. The rear wall 44 is located opposite to the first through eighth microphones. The base board 42 makes an acute angle with the bottom wall 12.

The base board 42 is position in the above-described manner for the following reason. If the base board 42 was disposed horizontal so that a major surface of the base board 42 can contact the bottom surface 12, the voice of the speaker would be directed slantwise from above the first through eighth microphones 14-1 through 14-8 since the head of the speaker is above the top plate 6. Then, the voice would be reflected by the horizontally disposed base board 42, and the reflected voice may be directed toward the first through eighth microphones 14-1 through 14-8. Then, the reflected voice would enter into the respective cases 16 through the through-holes 22 formed through the end surfaces of the respective cases 16 and collected by the respective microphone elements 20, which could degrade the single directivity of the first through eighth microphones 14-1 through 14-8.

In the described embodiment, the base board 42 is disposed to face the rear wall 44 as shown in FIG. 3. As a result, the voice reflected by the slanting base board 42 is not directed toward the first through eighth microphones 14-1 through 14-8, as indicated by an arrow b in FIG. 3. With this arrangement, the single directivity, or unidirectivity, of the first through eighth microphones 14-1 through 14-8 can be maintained.

For the same reason, as shown in FIG. 5, the inward surface of a side wall of the casing 8, i.e. the surface on the side facing the first through eighth microphones 14-1 through 14-8, is also made slant at an acute angle upward from the bottom wall 12, whereby the voice coming toward the inward surface 46*a* of the side wall 46 slantwise from above the speech stand and reflected therefrom hardly goes toward the first through eighth microphones 14-1 through 14-8, as indicated by an arrow c.

In the above-described embodiment, the first through eighth microphones 14-1 through 14-8 are disposed directly on the bottom wall 12, but they may be mounted on a microphone mounting member separately disposed on the bottom wall 12. Eight, in total, microphones, namely, the first through eighth microphones 14-1 through 14-8, are used in the described embodiment, but any number of microphones may be used only if they can provide three or more microphone units. For example, the number of the microphones may be five or larger. In the described embodiment, the eighth microphone 14-8 is provided, but, if a smaller microphone array is desired, the eighth microphone 14-8 can be removed.

In the described embodiment, the audio signals in the analog form from the first through eighth microphones 14-1 through 14-8 are supplied directly to the variable delay circuits 24-1 through 24-8, and, accordingly, the variable delay circuits 24-1 through 24-8, the beam forming section 26 and the speaker's position guessing section 40 are formed of analog processing circuitry. However, the audio signals from the first through eighth microphones 14-1 through 14-8 may be digitized. In such case, the variable delay circuits 24-1 through 24-8, the beam forming section 26 and the speaker's position guessing section 40 are formed of digital circuitry. In other case, the variable delay circuits 24-1 through 24-8 may be removed. In such case, the speaker's position guessing section 40 is also removed.

The invention claimed is:

1. A microphone system comprising a microphone array including first through n-th microphone units (where n is an integer equal to or greater than three);

wherein:

said first microphone unit of said microphone array being formed of three microphones arranged in line at regular intervals;

an m-th microphone unit (where m is a positive integer expressed by $1<m<n$) includes a microphone at one end of the m-th microphone unit, a microphone at the other end of the m-th microphone unit, and a microphone at the center of the m-th microphone unit, said microphone at said one end of said m-th microphone unit being a microphone at one end of an (m−1)-th microphone unit, said microphone at the center of said m-th microphone unit being a microphone at the other end of said (m−1)-th microphone unit, said microphone at said other end of said m-th microphone unit being disposed, spaced from said microphone at the center of said m-th microphone unit by a distance substantially equal to the distance between said microphone at said center of said m-th microphone unit and said microphone at said one end of said m-th microphone unit; said microphone at the center of said m-th microphone unit being interposed between said microphone at said one end of said m-th microphone unit and said microphone at said other end of said m-th microphone unit;

an (m+1)-th microphone unit includes a microphone at one end of the (m+1)-th microphone unit, a microphone at the other end of the (m+1)-th microphone unit, and a microphone at the center of the (m+1)-th microphone unit; said microphone at said center of said (m+1)-th microphone unit being said microphone at said one end of said m-th microphone unit, said microphone at said other end of said (m+1)-th microphone unit being said microphone at said other end of said m-th microphone unit, said microphone at said one end of said (m+1)-th microphone unit being spaced from said microphone at the center of said (m+1)-th microphone unit by a distance substantially equal to the distance between said microphone at said other end of said (m+1)-th microphone unit and said microphone at said center of said (m+1)-th microphone unit, said microphone at said center of said (m+1)-th microphone unit being interposed between said microphone at said one end of said (m+1)-th microphone unit and said microphone at said other end of said (m+1)-th microphone unit;

wherein said microphone system further comprises:

first adders each provided for each of said first through n-th microphone units, each of said first adders being configured to combine audio signals generated by said microphones of the associated microphone unit as a result of sound collection by said microphones of said associated microphone unit, and to output a resultant signal therefore; and a second adder provided for said first adders, said second adder being configured to receive said resultant signals outputted from said respective first adders and to combine said received resultant signals; and wherein:

in order to form an (n+1)-th microphone unit, said microphone array is further arranged in such a manner that:

a microphone chosen from the microphones of said first through n-th microphone units other than the microphones at the opposite ends and the center of the n-th microphone unit is used as a centrally disposed microphone of said (n+1)-th microphone unit, said centrally disposed microphone of said (n+1)-th microphone unit being spaced from one of the microphones at the opposite ends of said n-th microphone unit by a distance larger than the distance between said microphone at the center of said n-th microphone unit and said one of the microphones at the opposite ends of said n-th microphone unit;

that one of said microphones at said opposite ends of said n-th microphone unit, which is spaced from said centrally disposed microphone of said (n+1)-th microphone unit by a distance larger than said distance between said microphone at the center of said n-th microphone unit and said one of the microphones at said opposite ends of said n-th microphone unit, is used as a microphone at a first end of said (n+1)-th microphone unit; and said microphone array further includes another microphone disposed at a second end of said (n+1)-th microphone unit, said microphone at said second end of said (n+1)-th microphone unit being disposed at a location which is spaced from said centrally disposed microphone of said (n+1)-th microphone unit by a distance substantially equal to the distance between said microphone at said first end of said (n+1)-th microphone unit and said centrally disposed microphone of said (n+1)-th microphone unit, said centrally disposed microphone of said (n+1)-th microphone unit being interposed between said microphone at said first end of said (n+1)-th microphone unit and said microphone at said second end of said (n+1)-th microphone unit; and wherein said microphone system further comprises a third adder provided for said microphones at said first and second ends of said (n+1)-th microphone unit and said centrally disposed microphone of said (n+1)-th microphone unit, for combining audio signals generated by respective ones of said microphones at said first and second ends and said centrally disposed microphone of said (n+1)-th microphone unit as a result of sound collection by said microphones at said first and second ends and said centrally disposed microphone of said (n+1)-th microphone unit, a resultant signal from said third adder being supplied to said second adder.

2. The microphone system according to claim 1, wherein each of said microphones of said first through n-th microphone units has a microphone element within a case, said case being embedded in a microphone mounting section in such a manner that said microphone element is substantially tangential to a top of said microphone mounting section.

3. The microphone system according to claim 1, wherein a base board on which said first and second adders are disposed is disposed slantwise with respect to said microphone array.

4. The microphone system according to claim 1, wherein said microphone array is disposed in a casing, side walls of said casing being located outward of opposite ends of said microphone array, said walls being slantwise with respect to said microphone array.

* * * * *